United States Patent [19]

Eguchi et al.

[11] 4,406,237

[45] Sep. 27, 1983

[54] SUTURING INSTRUMENT FOR SURGICAL OPERATION

[75] Inventors: Yasukata Eguchi, Kunitachi; Reishi Nomoto, Tsukui, both of Japan

[73] Assignee: Janome Sewing Machine Co. Ltd., Tokyo, Japan

[21] Appl. No.: 263,467

[22] Filed: May 13, 1981

[30] Foreign Application Priority Data

May 23, 1980 [JP] Japan ..... 55-70262[U]

[51] Int. Cl.[3] ..... D05B 1/00

[52] U.S. Cl. ..... 112/169; 128/334 R

[58] Field of Search ..... 112/169, 185, 194, 195; 128/334 R, 334 C, 339, 326

[56] References Cited

U.S. PATENT DOCUMENTS

| | | | |
|---|---|---|---|
| 1,258,594 | 3/1918 | Miller | 112/169 |
| 2,479,017 | 8/1949 | Merson et al. | 112/169 |
| 2,507,814 | 5/1950 | Rantanen | 112/169 |
| 2,577,240 | 12/1951 | Findley | 128/325 |
| 3,957,004 | 5/1976 | Ketterer et al. | 112/169 |

*Primary Examiner*—H. Hampton Hunter

*Attorney, Agent, or Firm*—Michael J. Striker

[57] ABSTRACT

A suturing instrument for surgical operations comprises a curved needle holding a needle thread and a shuttle positioned on a support and manually displaceable back and forth relative to the needle. The shuttle is formed with an element for holding one knotted end of a shuttle thread which has a required length for carrying out the surgical operation. As the shuttle is moved towards and backwards of the needle the needle thread and the free end portion of the shuttle thread form lock stitches in a wound to be sewn up.

12 Claims, 13 Drawing Figures

SUTURING INSTRUMENT FOR SURGICAL OPERATION

BACKGROUND OF THE INVENTION

The invention relates to a suturing instrument for surgical operation, and more particularly relates to a structure of a shuttle of the suturing instrument which is moved relative to a curved needle of the suturing instrument to form lock stitches for stitching up the wound or the cut out flesh.

So far the surgical operator has manually operated the curved needle with a suture thread to sew up the wound or the cut out flesh. Such a manual starting operation requires a special skill and is also time consuming.

SUMMARY OF THE INVENTION

The invention has been provided to eliminate such defects and disadvantages of the prior art. It is a primary object of the invention to provide a suturing instrument, in which a shuttle is moved relative to a curved needle having a needle thread to lock the needle thread with a shuttle thread to form up lock stitches for sewing up the wound or the cut out flesh, said shuttle holding a predetermined length of shuttle thread in dependence upon the length of the wound, instead of holding a bobbin loaded with the shuttle thread, thereby reducing the size of the shuttle and the shuttle holder of the suturing instrument for the purpose of heightening the suturing function of the instrument and also enlarging the usability of the instrument to the various wounds to be sewn up at various parts of the patient.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE INVENTION

Figure 1:
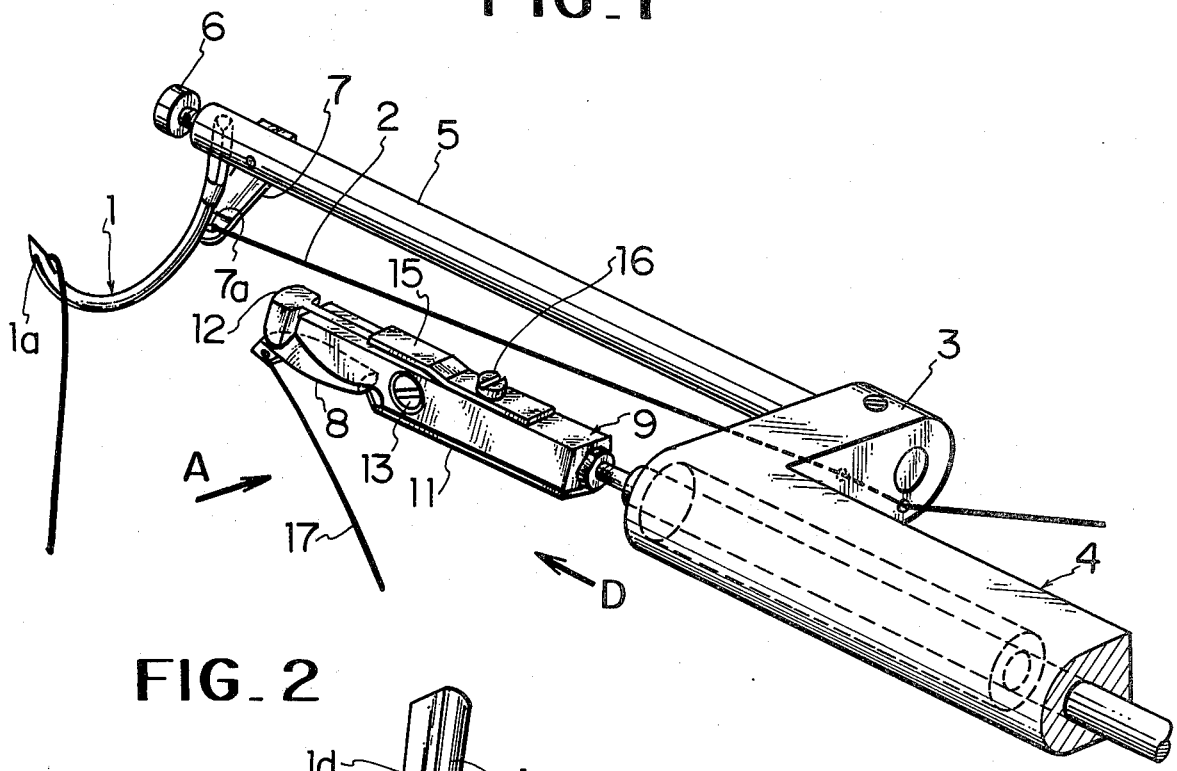
FIG. 1 is a perspective view of a main part of the suturing instrument of the invention.
Figure 2:
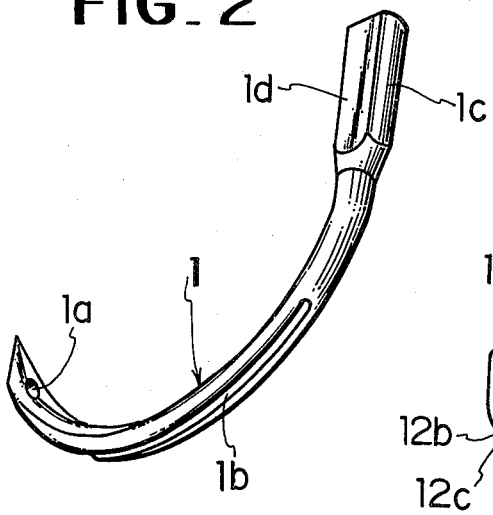
FIG. 2 is an enlarged view of a curved needle of the suturing instrument.

In reference to FIGS. 1 and 2, a curved needle (1) is semi-circular having a needle eye (1*a*) formed near a needle point on one end thereof, and having a shank (1*c*) formed on the other end thereof. A peripheral groove (1*b*) is provided on the outer side of the needle (1) along the substantial length of the needle for guiding a suture-thread (2) to the needle eye (1*a*). The shank (1*c*) of the needle has a flat face (1*d*) formed on one side thereof for positioning the needle (1) with respect to a needle bar (5) which is at one end secured to a laterally extended arm (3) of a support (4). The needle (1) is removably secured to the free end of the needle bar (5) by a fastening screw (6).

Figure 12:
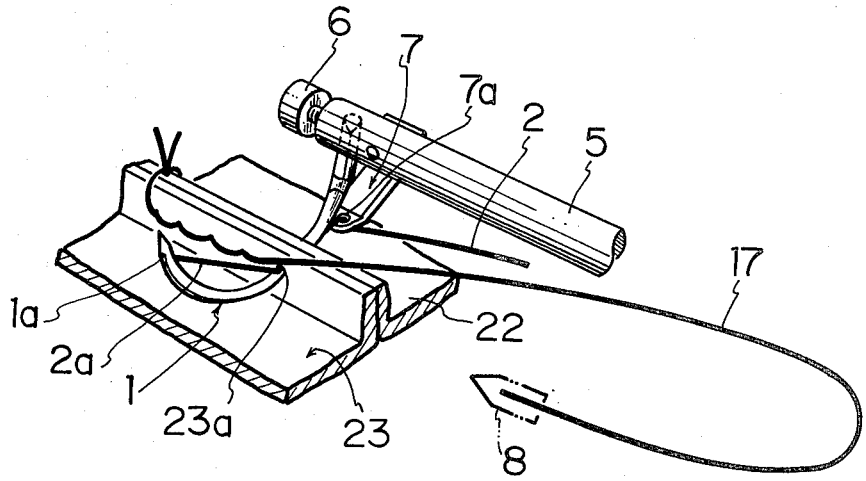
FIG. 12 is a perspective view showing a suturing process by the suturing instrument.

The suture-thread (2) is drawn out of a bobbin (not shown) which may be mounted on a proper part of the support (4), and is led into the needle eye (1*a*) of the needle (1) through a guide (7) and the peripheral groove (1*b*) of the needle (1). The guide (7) is secured to the needle bar (5) in the neighbourhood of the needle (1). As the needle is passed through one side of a flesh (22, 23) to be stitched and projects from the flesh on the opposite side thereof, a loop 2*a* of thread (2) is formed extending between the needle eye (1*a*) and a part (23*a*) of the needle (1) which is in the flesh (23*a*) as shown in FIG. 12. The thread loop (2*a*) is locked with a shuttle suture-thread (17) to form a lock stitch as will be mentioned in detail herein.

Figure 3:
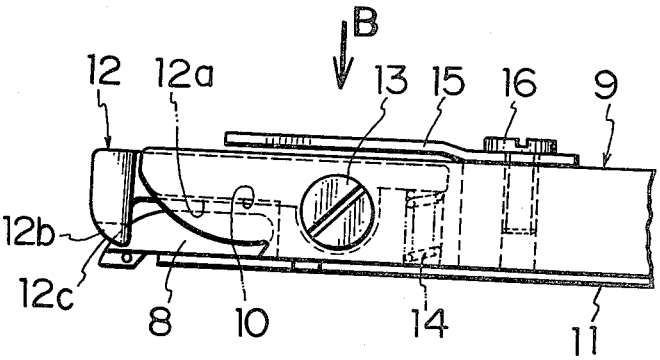
FIG. 3 is a side elevational view of a shuttle holder of the suturing instrument, seen from the direction A as shown in FIG. 1.
Figure 4:
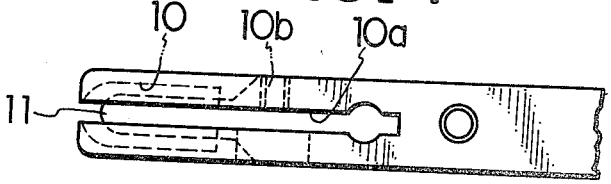
FIG. 4 is a plan view of the shuttle holder seen from the direction B in FIG. 3.
Figure 5:
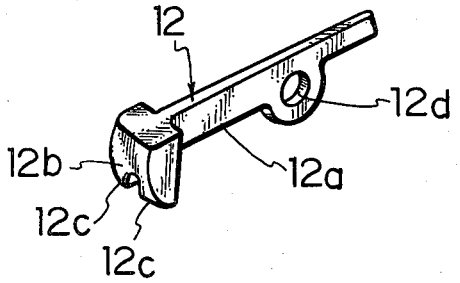
FIG. 5 is a perspective view of a shuttle detaining element of the suturing instrument.

In reference to FIGS. 3–6, a shuttle 8 is in a shuttle holder (9) which is a box-shaped hollow frame with a bottom plate 11 for supporting the shuttle (8) thereon. The shuttle holder (9) is mounted on the support (4) and is mannually movable relative to the curved needle (1). The shuttle holder (9) provides a chamber (10) at the front part thereof for holding the shuttle 8 therein. The shuttle holder (9) is formed with a slot (10*a*) at the upper wall thereof for turnably mounting thereon a shuttle detaining element (12). FIG. 5 shows the shuttle detaining element (12) having an elongated shank (12*a*), a mounting hole (12*d*) provided at the intermediate part of the shank (12*a*) and a pawl (12*b*) provided at one end of the shank (12*a*). The pawl (12*b*) is forked at lower end thereof to form shuttle detaining parts (12*c*, 12*c*). The front face of the pawl (12*b*) is smoothed and inclined towards the shuttle detaining parts (12*c*, 12*c*). The shuttle detaining element (12) is inserted into the slot (10*a*) of the shuttle holder (9) and is turnably mounted to the shuttle holder (9) by a stepped screw (13) which is transversely inserted into the side wall of the shuttle holder (9) and into the mounting hole (12*d*) of the shuttle detaining element (12) and is threaded into a threaded hole (10*b*) formed in the opposite side wall of the shuttle holder (9) as shown in FIG. 3.

As shown in FIG. 3, the shuttle detaining element (12) is normally biased in the counterclockwise direction by a spring (14) acting on the right side end of the shank (12*a*), so that the forked parts (12*c*, 12*c*) of the pawl (12) may be lightly pressed against the forward end of the shuttle (8) which is held in the chamber (10) of the shuttle holder (9). The turning movement of the shuttle detaining element (12) in the clockwise and counterclockwise directions is limited by a stopper plate (15) secured to the upper wall of the shuttle holder (9) by a fastening screw (16).

Figure 6:
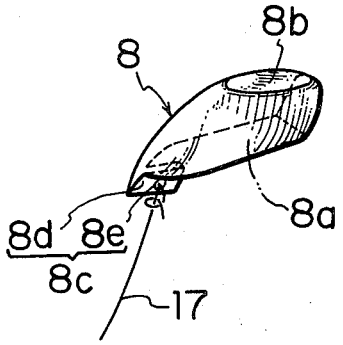
FIG. 6 is a perspective view of a shuttle of the suturing instrument.

As shown in FIG. 6, the shuttle (8) is substantially streamlined and is pointed at the forward end thereof with a top (8*b*) partly flattened and a bottom all flattened to be placed against the bottom plate (11) of the shuttle holder (9).

As to the surgical suturing instrument, it is generally preferable to reduce the shuttle and the shuttle holder into the minimum possible dimensions so as to enlarge the available region of the suturing instrument in the medical operations. In this respect, if the shuttle (8) is structured to contain a bobbin loaded with the shuttle thread, the dimensional reduction of the shuttle and the shuttle holder is considerably limited.

In contrast to the conventional suturing instrument having a shuttle incorporated with a shuttle-thread bobbin, the suturing instrument of this invention has a shuttle holding one end of a shuttle-thread, instead of being incorporated with the shuttle-thread bobbin. According to the embodiments of this invention the streamlined shuttle 8 of the first embodiment has, as shown in FIG. 6, a thread holding structure (8*c*) formed on the bottom (8*a*) at the forward end thereof, consisting of a projection (8*d*) directed below with an eyelet (8*b*) through which one end of shuttle thread (17) is knotted to the projection (8*d*). The shuttle-thread (17) may be long enough to suture up the wounds of various lengths.

Figure 7:
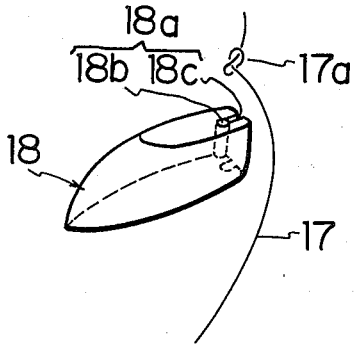
FIG. 7 is a perspective view of another embodiment of the shuttle.
Figure 8:
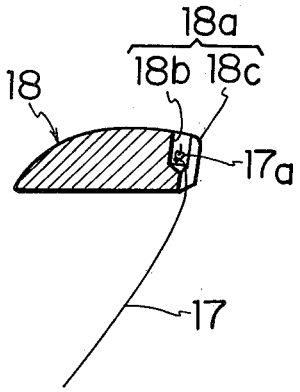
FIG. 8 is a vertical section of the shuttle in FIG. 7 taken lengthwise thereof.
Figure 9:
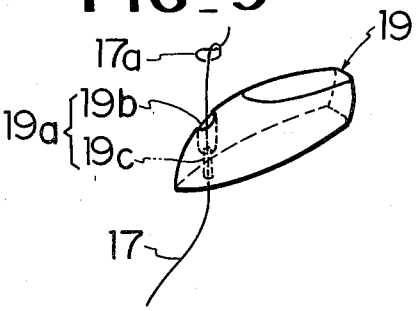
FIG. 9 is a perspective view of another embodiment of the shuttle.

A shuttle (18) of the second embodiment according to this invention is shown in FIGS. 7 and 8. The shuttle (18) has a thread holding structure (18*a*) provided at the rearward end thereof. The thread holding structure (18*a*) consists of a vertical bore (18*b*) opened at the top of the shuttle, and a vertical slot (18*c*) provided at the rear end of the shuttle and conducted to the vertical bore (18*b*) for guiding the shuttle thread (17) therethrough into the vertical bore (18*b*). The shuttle thread (17) of a predetermined length is knotted at one end (17*a*) thereof, so that the knot (17*a*) may be held in the vertical bore (18*b*) and the thread (17) may be drawn out of the bore (18*b*) through the slot (18*c*). The same shuttle-thread holding part (19*a*) may be provided at the front end part of the shuttle (19) as shown in FIG. 9, in which a vertical bore (19*b*) is formed near the front pointed end of the shuttle for holding the knotted end of the shuttle thread 17 and a vertical slot (19*c*) is formed on one side of the shuttle, conducted to the vertical bore (19*b*), so that the thread (17) may be drawn out therethrough from the vertical bore (19*b*).

With such structures of shuttle as shown in FIGS. 6–9, it is possible to connect the thread (17) to the shuttle without taking the shuttle out of the shuttle holder (9) of the suturing instrument, because the bottom plate (11) of the shuttle holder (9) is reduced in width at the forward part thereof to support the shuttle (8) thereon and the side walls of the shuttle holder (9) are cut out at the lower part thereof from the forward end to the intermediate part thereof in the substantial length of the shuttle (8), the pointed end of which being projected out of the forward end of the holder (9) as shown in FIGS. 1–4.

Figure 10:
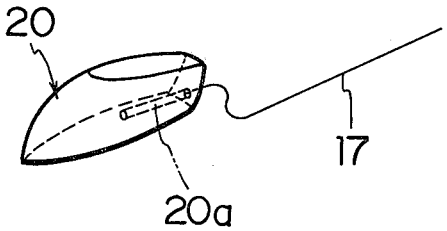
FIG. 10 is a perspective view of yet another embodiment of the shuttle.
Figure 11:
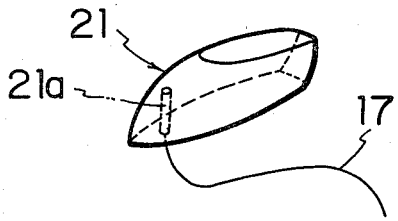
FIG. 11 is a perspective view of still another embodiment of the shuttle.

FIG. 10 shows a shuttle (20) of another embodiment having one end of the shuttle thread (17) embedded in a part (20*a*) at the rear end part thereof and fixedly binded or melted thereto in the production process thereof. FIG. 11 shows a shuttle (21) of another embodiment having one end of the thread embedded in a part (21*a*) at the forward end part thereof and fixedly binded or melted thereto. These shuttles (20, 21) are replaced by a new shuttle each time after the suturing operation is finished or the shuttle thread (17) is consumed up. The replacement of shuttle is implemented by loosening the fastening screw (16) and by turning the detaining element (12) in the clockwise direction in FIG. 3.

Figure 13:
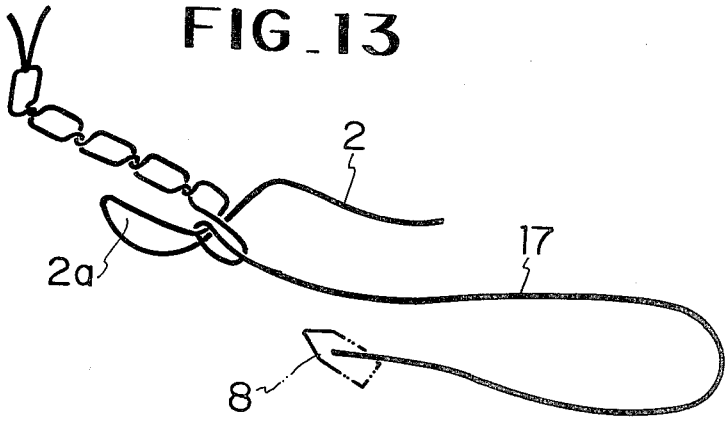
FIG. 13 is a perspective view showing a series of lock stitches formed by the suturing instrument.

Operation of this invention is as follows; The shuttles of the embodiments are represented by the shuttle (8) because any of the shuttles (8, 18, 19, 20, 21) will produce the same lock stitch in cooperation with the curved needle (1). With manipulation of the suturing instrument by the support (4), the curved needle (1) is inserted into the flesh (22, 23) from one side thereof and is projected from the opposite side thereof as shown in FIG. 12. Then a thread loop (2*a*) is formed up extending between the needle eye (1*a*) and a point (23*a*) of the flesh (23) from which the needle (1) is projected out. The shuttle holder (9) is then operated to move towards the thread loop (2*a*) in the direction as shown by an arrow (D) in FIG. 1. As the shuttle holder (9) is further moved, the thread loop (2*a*) is guided into between the streamlined pointed end of the shuttle (8) and the forked parts (12*c*, 12*c*) of the shuttle detaining pawl (12*b*), slightly turning the detaining element (12) in the clockwise direction against the action of the spring (14) in FIG. 3. The thread loop (2*a*) is further guided on the upper face of the streamlined shuttle lengthwise thereof and comes to the vertical inclined rear end of the shuttle (8). Then as the shuttle holder (9) is moved back, the thread loop (2*a*) is guided into between the flat bottom (8*a*) of the shuttle (8) and the support plate (11). As the shuttle holder (9) is further moved back, the thread loop (2*a*) is drawn out of the shuttle holder (9). In the meantime, the thread loop (2*a*) is locked with the shuttle thread (17) as shown in FIG. 13. Then as the needle (1) is drawn out of the flesh (22, 23), the needle thread (2) and the shuttle thread (17), which are locked with each other, are tightened to form a stitch. With repetition of the same operation by the suturing instrument, a series of suturing stitches are produced to suture up the wounded flesh (22, 23).

It will be understood that each of the elements described above, or two or more together, may also find a useful application in other types of suturing instruments differing from the types described above.

While the invention has been illustrated and described as embodied in a suturing instrument, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A suturing instrument for surgical operation, comprising a curved needle for carrying a needle thread; a shuttle for carrying a shuttle thread; stationary supporting means for supporting said needle in stationary position with respect thereto; and holder means for holding said shuttle and mounted on said supporting means, said holder means being manually movable relative to said supporting means towards and away from said curved needle so that said shuttle held by the holder means cooperates with said curved needle to form lock stitches in a wound to be sewn up, said holder means including a box-shaped hollow frame accommodating said shuttle, a detaining element having a pawl for detaining said shuttle in said frame and an elongated shank turnably mounted on said frame, and a spring acting on said shank as to press said pawl against said shuttle.

2. The suturing instrument of claim 1, wherein said shuttle is formed with a projection and an eyelet provided in said projection for holding a knotted end of the shuttle thread.

3. The suturing instrument of claim 1, wherein said shuttle has a front end directed towards said needle and an opposite rear end.

4. The suturing instrument of claim 3, wherein said shuttle is formed with a bore for holding the knotted end of the shuttle thread, and a slot communicating with said bore and operative for guiding the shuttle thread into and out of said bore.

5. The suturing instrument of claim 4, wherein said bore and said slot are provided at the rear end of said shuttle.

6. The suturing instrument of claim 4, wherein said bore and said slot are provided at the front end of said shuttle.

7. The suturing instrument of claim 3, wherein said shuttle has an elongated element inserted therein, the shuttle thread being fixedly secured to said element.

8. The suturing instrument of claim 1, wherein said shuttle is interchangeable.

9. The suturing instrument of claim 8, wherein said element is located in the vicinity of said front end of said shuttle.

10. The suturing instrument of claim 8, wherein said element is located in the vicinity of said rear end of said shuttle.

11. The suturing instrument of claim 1, wherein said pawl is provided with a fork-shaped portion abutting against said shuttle for supporting the same in said frame.

12. The suturing instrument of claim 11, including a stop member on said holder means for limiting the turnable movement of said shank.

* * * * *